United States Patent [19]

Friel

[11] Patent Number: 4,882,466

[45] Date of Patent: Nov. 21, 1989

[54] ELECTRICAL DEVICES COMPRISING CONDUCTIVE POLYMERS

[75] Inventor: Kevin J. Friel, San Mateo, Calif.

[73] Assignee: Raychem Corporation, Menlo Park, Calif.

[21] Appl. No.: 189,938

[22] Filed: May 3, 1988

[51] Int. Cl.[4] ..... H05B 3/14

[52] U.S. Cl. ..... 219/219; 219/345; 219/505

[58] Field of Search ..... 219/213, 219, 345, 543, 219/504, 505

[56] References Cited

U.S. PATENT DOCUMENTS

| | | | |
|---|---|---|---|
| 3,221,145 | 11/1965 | Hager | 219/345 |
| 3,887,788 | 6/1975 | Seibel | 219/219 |
| 4,330,703 | 5/1982 | Horsma et al. | 219/553 |
| 4,388,607 | 6/1983 | Toy | 219/549 |
| 4,628,187 | 12/1986 | Sekiguchi et al. | 219/505 |
| 4,631,391 | 12/1986 | Tiepke | 219/219 |
| 4,684,785 | 8/1987 | Cole | 219/505 |
| 4,719,335 | 1/1988 | Batliwalla et al. | 219/528 |
| 4,761,541 | 8/1988 | Batliwalla et al. | 219/528 |
| 4,777,351 | 10/1988 | Batliwalla et al. | 219/528 |

FOREIGN PATENT DOCUMENTS

| | | | |
|---|---|---|---|
| 2822335 | 5/1979 | Fed. Rep. of Germany | 219/345 |
| 59-226493 | 12/1984 | Japan . | |

*Primary Examiner*—Teresa J. Walberg

*Attorney, Agent, or Firm*—Marguesite E. Gerstner; Timothy H. P. Richardson; Herbert G. Burkard

[57] ABSTRACT

An electrical device includes a laiminar resistive element which exhibits PTC behavior and two electrodes which exhibit ZTC behavior. The electrodes have a geometry which results in a resistance that is greater than the resistance of the resistive elements. The electrical device, which may be a heater, can be designed to produce a uniform power distribution over the surface of the device.

20 Claims, 2 Drawing Sheets

ELECTRICAL DEVICES COMPRISING CONDUCTIVE POLYMERS

BACKGROUND OF THE INVENTION

Field of the Invention

This invention relates to electrical devices comprising conductive polymers.

Background of the Invention

Conductive polymers, and heaters, circuit protection devices, sensors and other electrical devices comprising them, are well-known.

Electrical devices which comprise a laminar conductive polymer substrate are also known. For example, U.S. Pat. No. 4,330,703 (Horsma, et al.) discloses a self-regulating heating article which is designed such that, when powered, current flows through at least part of the thickness of a layer which exhibits positive temperature coefficient of resistance (PTC) behavior and then through a contiguous layer which exhibits zero temperature coefficient of resistance (ZTC or constant wattage) behavior. U.S. Pat. No. No.4,719,335 (Batliwalla, et al.) and copending, commonly assigned applications Ser. Nos. 51,438, now U.S. Pat. No. 4,761,541, and 53,610, now U.S. Pat. No. 4,777,351, (both Batliwalla, et al.) disclose self-regulating heaters which comprise an interdigitated electrode pattern attached to a PTC substrate. The electrode pattern may be varied in order to generate different power densities over the surface of the heater and, in some embodiments, the electrodes may be resistive, i.e. supply some of the heat when the heater is powered. U.S. Pat. No. 4,628,187 (Sekiguchi, et al.) discloses a heating element in which a pair of electrodes positioned on an insulating substrate is connected by a resistive layer comprising a PTC conductive polymer paste. U.S. Pat. No. 3,221,145 (Hager) discloses large-area flexible heaters which comprise metal sheet electrodes which are separated by a "semi-insulating" layer, e.g. a conductive epoxy, adhesive film, or cermet. For all these heaters, the conductive polymer layer is the primary source of heat; the predominant function of the electrodes is to carry the current. Therefore, the resistance of the electrodes is usually substantially less than the resistance of the conductive polymer layer. As a result, the resistance stability of the heater is predominantly a function of the resistancce stability of the conductive polymer. In addition, the heaters may be subject to nonuniform power densities across the surface of the heater as a result of voltage drop down thte length of the electrode.

Japanese Patent Application No. 59-226493 discloses a strip heater in which two electrodes, at least one of which is a "high resistance" electrode with a resistance of between 0.1 and 5 ohms/m, are embedded in a conductive polymer matrix. In heaters of this type, heat is generated by both the conductive polymer and the resistive electrode. While such a design is useful for heaters of known length and geometry, the power output at a given voltage cannot be easily modified without changing either the resistivity of the conductive polymer or the resistive electrode or the physical dimensions of the heater, e.g. the distance between the electrodes.

SUMMARY OF THE INVENTION

I have now found that electrical devices which exhibit PTC behavior, have low inrush characteristics, have resistance stability, and can be designed to produce uniform power distribution over the surface of the device, can be made by the use of a resistive electrode attached to the surface of a laminar conductive polymer substrate. Therefore, in one aspect this invention provides an electrical device which comprises (1) a laminar resistive element which is composed of a conductive polymer composition which (a) exhibits PTC behavior, (b) comprises an organic polymer and, dispersed in the polymer, a particulate conductive filler, and (c) has a melting temperature, $T_m$; and (2) two electrodes which can be connected to a source of electrical power and which comprise a material which (a) has a resistivity of $1.0\times10^{-6}$ to $1.0\times10^{-2}$ ohm-cm, and (b) exhibits ZTC behavior at temperatures less than $T_m$, said electrodes (i) each having a length, 1, of from 0.1 to 1,000,000 inches and a width, w, of 0.005 to 10 inches such that the length to width ratio is at least 1000:1, (ii) each having a thickness of 0.0001 to 0.01 inch, (iii) each having a resistance, $R_e$, of 0.1 to 10,000 ohms, (iv) each attached to a flat laminar surface of the resistive element, and (v) together covering 10 to 90% of the surface area of the resistive element, said resistive element having a resistance, $R_{cp}$, which is than $R_e$ and is from 0.1 to 10,000 ohms when connected to a source of electrical power and the electrical device having a resistance, $R_h$, the resistances $R_e$, $R_{cp}$ and $R_h$ being measured when the electrodes are first connected to a source of electrical power with the whole device being at a uniform temperature of 23° C.

DETAILED DESCRIPTION OF THE INVENTION

Figure 1:
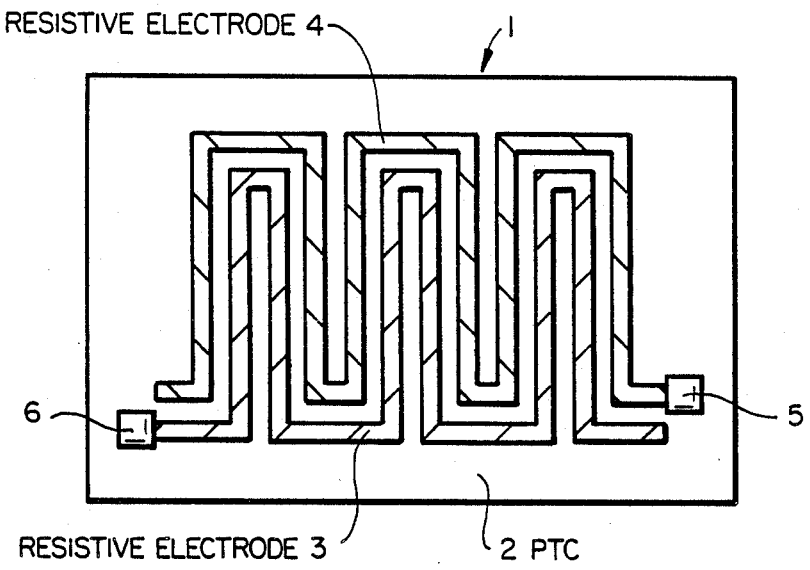
FIG. 1 is a plan view of an electrical device of the invention.

The resistive element used in devices of the invention comprises a conductive polymer which is composed of a polymeric component in which is dispersed a particulate conductive filler. The polymeric component is preferably a crystalline organic polymer or a blend comprising at least one crystalline organic polymer. The filler may be carbon black, graphite, metal, metal oxide, or a mixture comprising these. In some applications the filler may itself comprise particles of a conductive polymer. Such particles are distributed in the polymeric component and maintain their identity therein. The conductive polymer may also comprise antioxidants, inert fillers, prorads, stabilizers, dispersing agents, or other components. When the conductive polymer is applied to a substrate in the form of an ink or paste, solvents may also be a component of the composition. Dispersion of the conductive filler and other components may be achieved by dry-blending, melt-processing, roll-milling, kneading or sintering, or any process which adequately mixes the components. The resistive element may be crosslinked by chemical means or irradiation.

The preferred resistivity of the conductive polymer at 23° C. will depend on the dimensions of the resistive element and the power source to be used, but will generally be between 0.1 and 100,000 ohm-cm, preferably 1 to 1000 ohm-cm, particularly 10 to 1000 ohm-cm. For electrical devices suitable for use as heaters powered at 6 to 60 volts DC, the resistivity of the conductive polymer is preferably 10 to 1000 ohm-cm; when powered at 110 to 240 volts AC, the resistivity is preferably about 1000 to 10,000 ohm-cm. Higher resistivities are suitable for devices powered at voltages greater than 240 volts AC.

The composition comprising the resistive element exhibits PTC behavior with a switching temperature, $T_s$, defined as the temperature at the intersection of the lines drawn tangent to the relatively flat portion of the log resistivity vs. temperature curve below the melting point and the steep portion of the curve. If the resistive element comprises more than one layer the composite layers of the element must exhibit PTC behavior. The switching temperature may be the same as or slightly less than the melting temperature, $T_m$, of the conductive polymer composition. The melting temperature is defined as the temperature at the peak of a differential scanning calorimeter (DSC) curve measured on the polymer.

The term "composition exhibiting PTC behavior" is used in this specification to denote a composition which has an $R_{14}$ value of at least 2.5 or an $R_{100}$ value of at least 10, and preferably both, and particularly one which has an $R_{30}$ value of at least 6, where $R_{14}$ is the ratio of the resistivities at the end and the beginning of a 14° C. range, $R_{100}$ is the ratio of the resistivities at the end and the beginning of a 100° C. range, and $R_{30}$ is the ratio of the resistivities at the end and the beginning of a 30° C. range. For some applications, the conductive polymer composition should have a resistivity which does not decrease in the temperature range $T_s$ to $(T_s+20)$° C., preferably to $(T_s+40)$° C., particularly to $(T_s+75)$° C.

The resistive element is laminar and comprises at least one relatively flat surface. Depending on the desired flexibility and resistance of the electrical device, the resistive element may be of any suitable thickness, although it is usually between 0.0001 and 0.10 inch. When the resistive element comprises a melt-extruded conductive polymer, the thickness is between 0.005 and 0.100 inch, preferably 0.010 to 0.050 inch, particularly 0.010 to 0.025 inch. When the conductive polymer comprises a polymer thick film, the thickness of the resistive element is between 0.0001 and 0.005 inch, preferably 0.0005 to 0.003 inch, particularly 0.001 to 0.003 inch. For such cases, the substrate onto which the conductive polymer film is deposited may be a polymer film or sheet such as polyester or polyethylene, a second conductive polymer sheet, an insulating material such as alumina or other ceramic, or other suitable material, e.g. fiberglass. The area of the resistive element may be any size; most heaters have an area of 10 to 200 $in^2$.

The resistance of the resistive element, $R_{cp}$, is a function of the resistivity of the conductive polymer composition, the electrode pattern and resistance, and the geometry of the resistive element. For most applications, it is preferred that $R_{cp}$ is 0.01 to 1000 ohms, particularly 0.1 to 100 ohms, especially 1 to 100 ohms.

The electrodes of the invention serve to both carry current and to provide heat via $I^2R$ heating. They generally comprise a material which has a resistivity of $1.0\times10^{-6}$ to $1\times10^{-2}$ ohm-cm, and are preferably metal or a material, e.g. an ink, comprising a metal. A preferred material is copper, particularly electrodeposited or cold-rolled copper that has been etched by known techniques into an appropriate electrode pattern. Other suitable materials are thick film inks which are printed onto the resistive element or metals which have been vacuum deposited or sputtered onto the resistive element. While for most applications the electrodes are printed or etched directly onto the resistive element, in some cases the electrodes may be deposited onto a separate layer which is then laminated onto the resistive element.

The electrodes exhibit ZTC (zero temperature coefficient of resistance) behavior over the temperature range of interest. The term "ZTC behavior" is used to denote a composition which increases in resistivity by less than 6 times, preferably less than 2 times in any 30° C. temperature range below the $T_s$ value of the resistive element. The material comprising the electrodes may be PTC or NTC (negative temperature coefficient of resistance) at temperatures greater than $T_s$ of the conductive polymer comprising the resistive element. The resistance stability of the electrical device is enhanced by the presence of the electrodes, which, because they generally comprise metal, are less subject to oxidation and other processes which affect the resistance stability of the conductive polymer.

The electrodes may form a pattern of any shape which produces an acceptable resistance and electrical path, e.g. spiral or straight, although a serpentined pattern is preferred. The electrodes may be positioned on opposite surfaces of the resistive element or on the same surface. If the electrodes are on opposite surfaces, it may be preferred that they be positioned directly opposite one another so that the current path is substantially perpendicular to the surface of the laminar resistive element and little current flows parallel to the surface of the resistive element. Electrical connection is made to the electrodes at opposite ends of the electrical circuit. These "ends" may be physically adjacent to one another, but electrically are at opposite ends of the circuit.

The electrode pattern may cover from 10 to 99% of the total laminar surface area of the resistive element. For most applications for which the electrodes are on the same surface of the resistive element, at least 30%, preferably at least 40%, particularly at least 50% of the exposed surface is covered, i.e. at least 15%, preferably at least 20%, particularly at least 25% of the total surface area is covered.

In order to provide the maximum resistance value, the electrodes are preferably as thin as possible for a given applied voltage. The average thickness, t, is 0.0001 to 0.01 inch, preferably 0.0005 to 0.005 inch. For most applications, the electrode width, w, is 0.005 to 10 inch, preferably 0.005 to 1 inch, particularly 0.010 to 0.100 inch. In order to change the power output at any location on the surface of the resistive element, the electrode width or the spacing between the electrodes may be varied.

The length, 1, of each of the electrodes may be from 0.1 to $1\times10^6$ inches, preferably 1 to 10,000 inches, particularly 10 to 1000 inches and is dependent on the function of the electrical device. In order to enhance the resistive character of the electrodes, the ratio of the length to the width of the electrodes is at least 1000:1, preferably 1500:1, particularly 2500:1. When the electrode width varies down the length, the maximum width is used to determine this ratio. The resulting electrodes will each have a resistance at 23° C., $R_e$, of 0.1 to 10,000 ohms, preferably 1 to 1000 ohms, particularly 10 to 1000 ohms. For many applications it is desirable to vary the width of the electrode to an extent that the resistance per unit length of electrode changes by at least 5%, preferably at least 10%, particularly at least 20%, especially at least 25%.

The electrical devices of this invention are designed so that their resistance, $R_h$, is between 0.1 and 10,000 ohms, preferably 1 to 1000 ohms, particularly 10 to 1000 ohms. For these devices, when measured at 23° C., $R_{cp}$ is less than $R_e$. The ratio of $R_e$ to $R_{cp}$ is 1:1 to 1000:1, preferably 1:1 to 100:1, and the electrode resistance, $R_e$, comprises at least 50% of $R_h$, preferably at least 60% of $R_h$, particularly at least 70% of $R_h$. The high electrode resistance serves to minimize the inrush current when the electrical device is powered.

Electrical devices of the invention may be used as heaters or circuit protection devices. The exact dimensions and resistance characteristics of the device are dependent on the intended end use and applied voltage. One preferred application is the heating of mirrors or other substrates, e.g. the side mirrors or rear view mirrors on automobiles and other vehicles.

The invention is illustrated by the drawing, in which FIG. 1 shows a plan view of an electrical device 1 suitable for use as a heater. An electrode pair 3,4 of uniform width and spacing forms a serpentine pattern on the surface of a resistive element 2 which comprises a conductive polymer. Electrical connection to the electrodes is made by means of spade connectors 5,6.

Figure 2:
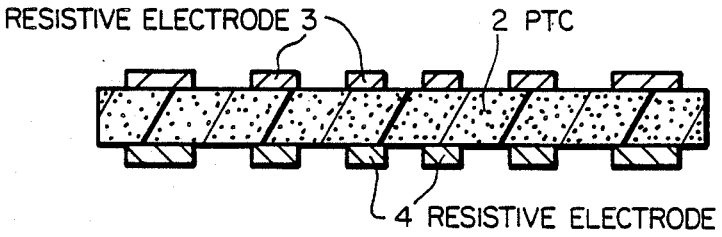
FIG. 2 is a cross-sectional view of an electrical device of the invention.

FIG. 2 is a cross-sectional view of an electrical device in which the electrodes 3,4 are positioned on opposite surfaces of the conductive polymer resistive element 2. The electrodes vary in width and spacing.

Figure 3:
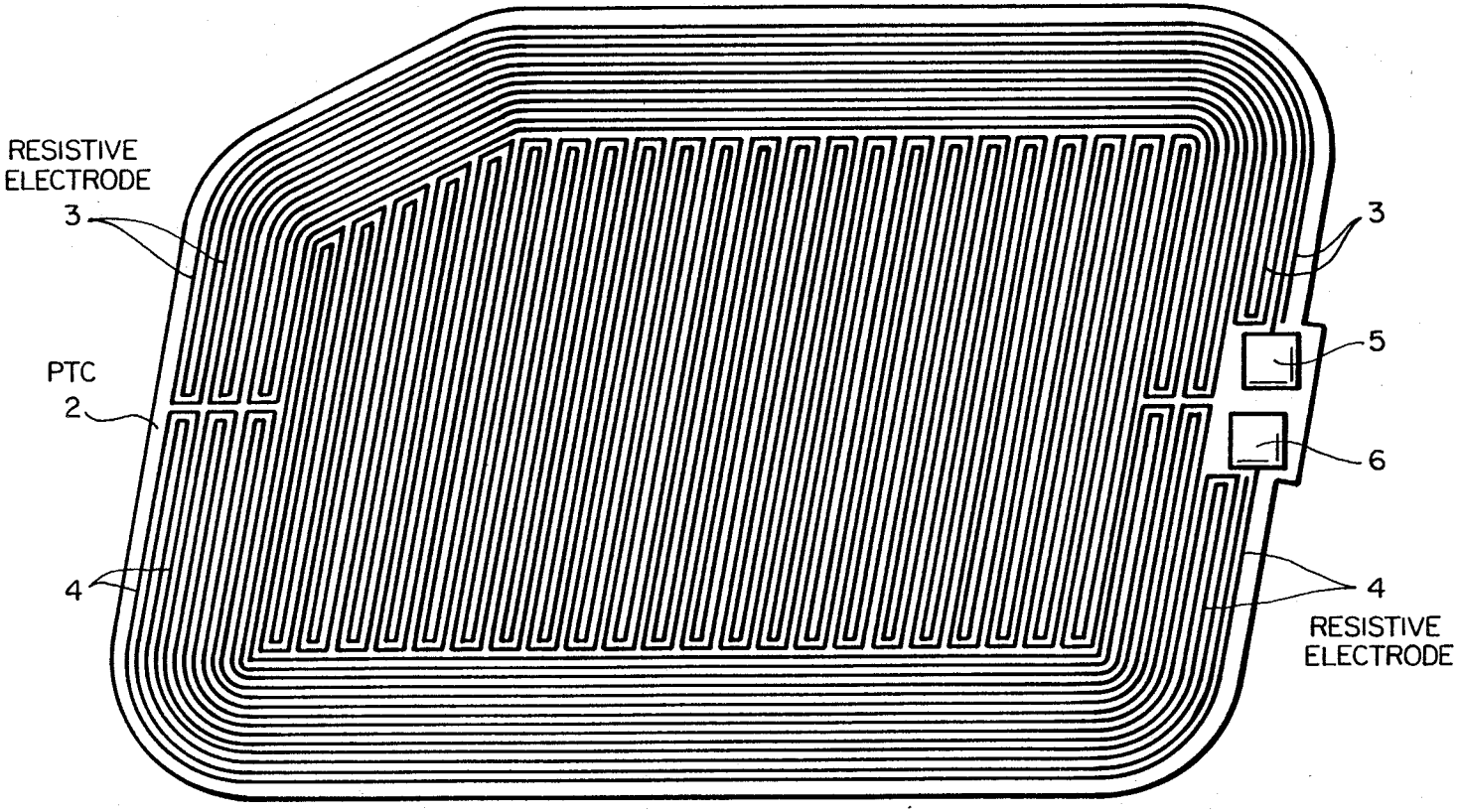
FIG. 3 is a plan view of a mirror heater made in accordance with the invention.

FIG. 3 is a plan view of an electrical device designed for use as a mirror heater. Electrodes 3,4 form a serpentine pattern on a conductive polymer resistive element and connection to a power source is made by means of connectors 5,6.

The invention is illustrated by the following example.

EXAMPLE

Conductive polymer pellets were made by mixing 53.8 wt. % ethylene acrylic acid copolymer (Primacor 1320, available from Dow Chemicals) with 43.2 wt. % carbon black (Statex G, available from Columbian Chemicals) and 3 wt. % calcium carbonate (Omya Bsh, available from Omya Inc.). The pellets were extruded to produce a sheet 0.010 inch (0.025 cm) thick. A resistive element measuring approximately 4.5 by 3.1 inches (11.43 by 7.87 cm) was cut from the conductive polymer sheet.

Using a resist ink (PR3003 available from Hysol), an electrode pattern was printed onto a substrate comprising 0.0007 inch (0.0018 cm) electrodeposited copper laminated onto 0.001 inch (0.0025 cm) polyester (Electroshield C18, available from Lamart). After curing the ink in a convection oven, the pattern was etched, leaving copper traces on a polyester backing. The copper traces produced two electrodes, each measuring approximately 0.019 inch (0.048 cm) wide and 200 inches (508 cm) long, which formed a serpentine pattern as shown in FIG. 3. This electrode pattern was laminated to one side of conductive polymer sheet and a 0.001 inch (0.0025 cm) polyester/polyethylene sheet (heat-sealable polyester film, available from 3M) was laminated to the other side. Electrical termination was made to the heater by means of spade type connectors.

What is claimed is:

1. An electrical device which comprises (1) a laminar resistive element which is composed of a conductive polymer composition which (a) exhibits PTC behavior, (b) comprises an organic polymer and, dispersed in the polymer, a particulate conductive filer, and (c) has a melting temperature, $T_m$; and (2) two electrodes which can be connected to a source of electrical power and which comprise a material which (a) has a resistivity of $1.0\times10^{-6}$ to $1.0\times10^{-2}$ ohm-cm, and (b) exhibits ZTC behavior at temperature less than $T_m$, said electrodes (i) each having a length l, of 0.1 to 1,000,000 inches and a width, w, of 0.005 to 10 inches such that the length to width ratio is at least 1000:1, (ii) each having a thickness of 0.0001 to 0.01 inch, (iii) each having a resistance, $R_e$, of 0.1 to 10,000 ohms, (iv) each attached to a flat laminar surface of the resistive element, and said resistive element having a resistance, $R_{cp}$, which is less than $R_e$ and is from 0.1 to 10,000 ohms when connected to a source of electrical power and the electrical device having a resistance, $R_h$, the resistances $R_e$, $R_{cp}$ and $R_h$ being measured when the electrodes are first connected to a source of electrical power with the whole device being at a uniform temperature of 23° C.

2. A device according to claim 1 wherein both electrodes are on the same surface of the resistive element.

3. A device according to claim 1 wherein the electrodes are on opposite surfaces of the resistive element.

4. A device according to claim 1 wherein the resistive element comprises conductive polymer that has been melt-extruded.

5. A device according to claim 1 wherein the conductive polymer is a polymer thick film ink.

6. A device according to claim 1 wherein $R_e$ is at least 50% of $R_h$.

7. A device according to claim 6 wherein $R_e$ is at least 60% of $R_h$.

8. A device according to claim 7 wherein $R_e$ is at least 70% of $R_h$.

9. A device according to claim 1 wherein the ratio of $R_e$ to $R_{cp}$ is at least 10:1.

10. A device according to claim 9 wherein the ratio of $R_e$ to $R_{cp}$ is at least 100:1.

11. A device according to claim 1 wherein the electrodes comprise copper.

12. A device according to claim 11 wherein the copper electrodes have been formed by etching a continuous layer of copper to produce a serpentined pattern.

13. A device according to claim 1 wherein the electrical device is a heater for mirrors.

14. A device according to claim 13 wherein the electrodes (a) comprise a material with a resistivity of $1\times10^{-6}$ to $1\times10^{-5}$ ohm-cm, (b) have a length of at least 100 inches, (c) have a length to width ratio of at least 1500:1, and (d) have a resistance of 0.5 to 200 ohms.

15. A device according to claim 1 wherein the resistance per unit length of at least one electrode varies.

16. A device according to claim 15 wherein the resistance per unit length varies by at least 5%.

17. A device according to claim 16 wherein the resistance per unit length varies by at least 10%.

18. A device according to claim 17 wherein the resistance per unit length varies by at least 20%.

19. A device according to claim 18 wherein the resistance per unit length varies by at least 25%.

20. A heated mirror for use on vehicles, which comprises (1) a mirror comprising a front mirrored surface and a back surface; and (2) attached to the back surface of the mirror, a heater which comprises (a) a laminar resistive element which is composed of a conductive polymer composition which exhibits PTC behavior;

(b) two electrodes which can be connected to a source of electrical power and which comprise a material which has a resistivity of $1\times10^{-6}$ to $1\times10^{-4}$ ohm-cm exhibits ZTC behavior, said electrodes (i) each having a length of 10 to 1000 inches and a width of 0.005 to 1 inch such that the length to width ratio is at least 1000:1, (ii) each having a thickness of 0.0005 to 0.005 inch, (iii) each having a resistance, $R_e$, of 0.1 to 1000 ohms, (iv) each attached to a flat laminar surface of the resistive element, and (v) together covering 10 to 90% of the surface area of the resistive element, said resistive element having a resistance $R_{cp}$ which is less than $R_e$ and is from 0.1 to 1000 ohms when connected to a source of electrical power and the heater having a resistance $R_h$, the resistances $R_e$, $R_{cp}$, and $R_h$ being measured when the electrodes are first connected to a source of electrical power with the whole device being at a uniform temperature of 23° C.

* * * * *